US008469774B2

(12) United States Patent
Li et al.

(10) Patent No.: US 8,469,774 B2
(45) Date of Patent: Jun. 25, 2013

(54) AMORPHOUS ALLOY COMPONENT AND SURFACE TREATING METHOD FOR MAKING SAME

(75) Inventors: Yang-Yong Li, Shenzhen (CN); Yi-Min Jiang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 205 days.

(21) Appl. No.: 13/104,208

(22) Filed: May 10, 2011

(65) Prior Publication Data

US 2012/0160374 A1 Jun. 28, 2012

(30) Foreign Application Priority Data

Dec. 28, 2010 (CN) ..... 2010 1 0609177

(51) Int. Cl.
*B24C 11/00* (2006.01)

(52) U.S. Cl.
USPC ..... 451/38; 451/37; 451/40; 451/57; 451/58; 148/561

(58) Field of Classification Search
USPC ..... 451/36–40
See application file for complete search history.

(56) References Cited

U.S. PATENT DOCUMENTS

| | | | | |
|---|---|---|---|---|
| 5,484,494 | A * | 1/1996 | Oda et al. | 148/561 |
| 7,560,001 | B2 * | 7/2009 | Peker | 148/561 |
| 8,070,559 | B1 * | 12/2011 | Li et al. | 451/57 |
| 8,253,068 | B2 * | 8/2012 | Yuan et al. | 219/121.72 |
| 2012/0220208 | A1 * | 8/2012 | Sung | 451/540 |

OTHER PUBLICATIONS

Production of Amorphous Iron-Nickel Based Alloys by Flame-Spray Quenching and Coatings on Metal Substrates by Miura et al.—Transactions of the Japan Institute of Metals, vol. 25, No. 4, pp. 284-291—1984.*

Liu Luofu,"Investigation on Microstructure and Properties of Fe-based Amorphous Coating Deposited by Plasma Spray"; "China Masters Theses Full-text Database (Electronic Journal)", Engineering Science and technology I; Aug. 15, 2009, 2009 Eighth, Sixteenth Pages.

* cited by examiner

*Primary Examiner* — George Nguyen
(74) *Attorney, Agent, or Firm* — Altis Law Group, Inc.

(57) ABSTRACT

The present invention relates to a surface treating method for making an amorphous alloy component. The surface treatment method includes the following steps: an amorphous alloy sheet is provided; the amorphous alloy sheet is fixed into a dry blast machine; and the surface of the amorphous alloy sheet is treated by sandblasting. In the sandblasting step, air pressure is controlled to be in a range from about 1.5 gf/cm$^2$ to 6.0 kgf/cm$^2$ and blasting time is in a range from about 1 second to 60 seconds; the sand used in sandblasting is preferably selected from a group consisting of aluminium oxide, zirconium dioxide and silicon dioxide, and a grain size of the sand is in a range from about 100 μm to 250 μm.

4 Claims, 4 Drawing Sheets

AMORPHOUS ALLOY COMPONENT AND SURFACE TREATING METHOD FOR MAKING SAME

BACKGROUND

1. Technical Field

The present disclosure relates to an amorphous alloy component, particularly to a zirconium-based (hereinafter referred to as Zr-based) amorphous alloy component and surface treating method for making the same.

2. Description of Related Art

Amorphous alloys are well known for having similar structural characteristics as that of glass. The amorphous alloys have properties of high strength, high toughness, and high corrosion resistance. Thus, the amorphous alloys are widely used to make structural parts of different electronic products such as mobile phones, MP3s, and PDAs, or sporting goods of manufacture such as, golf club heads. However, one downside to amorphous alloys is that they can be brittle and too easily fractured by external forces.

Therefore, there is room for improvement in the art.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the amorphous alloy sheet and surface treating method for making the same. Moreover, in the drawings like reference numerals designate corresponding parts throughout the several views. Wherever possible, the same reference numerals are used throughout the drawings to refer to the same or like elements of an embodiment.

DETAILED DESCRIPTION

Figure 1:
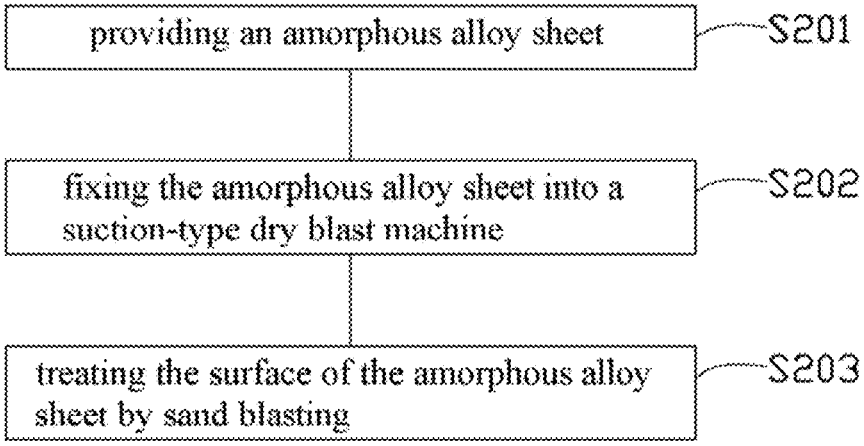
FIG. 1 shows a flowchart of a surface treating method for making an amorphous alloy component of an embodiment of the instant disclosure.

Referring to FIG. 1, a surface treating method for making an amorphous alloy member according to an embodiment of instant disclosure is illustrated as follows.

In step S201: an amorphous alloy component is provided. In the illustrated embodiment, the amorphous alloy component is a bulk-solidifying Zr-based amorphous alloy sheet, which includes, in this embodiment, 50 to 70 weight percent zirconium (Zr), 10 to 15 weight percent copper (Cu), 5 to 10 weight percent nickel (Ni), 5 to 20 weight percent niobium (Nb), and 5 to 10 weight percent aluminum (Al). It is to be understood that, the amorphous alloy sheet can also be iron (Fe)-based, cobalt (Co)-based, nickel (Ni)-based or other amorphous alloys.

In step S202: the amorphous alloy sheet is fixed into a suction-type dry blast machine.

In step S203: the surface of the amorphous alloy sheet is treated by sandblasting in the dry blast machine. In this step, air pressure is controlled to be in a range from about 1.5 kgf/cm$^2$ to 6.0 kgf/cm$^2$ and blasting time is controlled to be in a range from about 1 second to 60 seconds. In this embodiment, the sand is selected from a group consisting of aluminium oxide, zirconium dioxide, and silicon dioxide. A grain size of the sand is in a range from about 100 μm to 250 μm. An angle of a nozzle of the dry blast machine relative to a predetermined treating surface of the amorphous alloy sheet is in a range from about 10 degrees to 90 degrees. A distance from the nozzle to the predetermined treating surface of the amorphous alloy sheet is controlled to be in a range from about 10 centimeters to 50 centimeters.

A first embodiment of the surface treating method for making the amorphous alloy component includes the following steps. First, a Zr-based amorphous alloy component is provided. In the illustrated first embodiment, the amorphous alloy component is a bulk-solidifying Zr-based amorphous alloy sheet that has the following composition: $Zr_{57}Nb_5Cu_{15.4}Ni_{12.6}Al_{10}$. Second, the amorphous alloy sheet is fixed into a suction-type dry blast machine. Last, the Zr-based amorphous alloy sheet is treated by sandblasting. During the sandblasting process, the air pressure is 2.5 kgf/cm$^2$, the blast time is 20 seconds, the sand is aluminium oxide, the grain size of the aluminium oxide sand is 100 μm, the angle of the nozzle of the dry blast machine relative to a predetermined treating surface of the amorphous alloy sheet is 90 degrees, and the distance from the nozzle to the predetermined treating surface of the amorphous alloy sheet is 30 centimeters.

Figure 2:
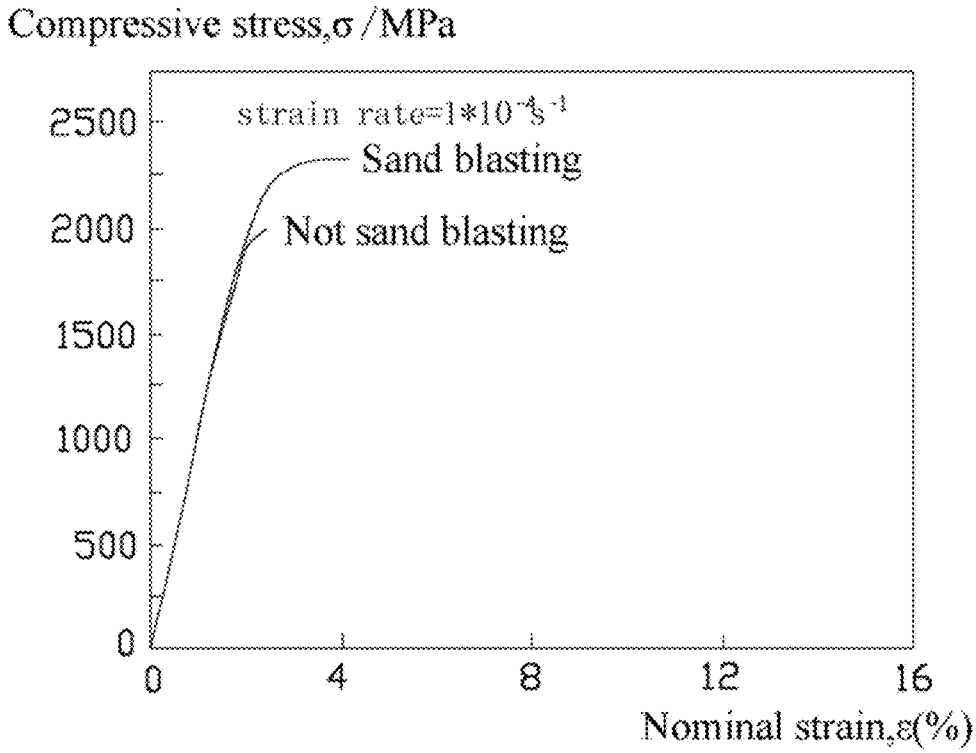
FIG. 2 shows a graph of a plurality of stress-strain curves of Zr-based amorphous alloy with and without sandblasting treatment.

Referring to FIG. 2, after the sandblasting treatment, the surface roughness of the Zr-based amorphous alloy component is increased from 0.015 μm to 1.162 μm, the fracture strain is increased from 2.20% to 2.80%, and the compressive strength is increased from 2000 MPa to 2430 MPa.

A second embodiment of the method for making the Zr-based amorphous alloy component is similar to the first embodiment, except that the air pressure is 4.5 kgf/cm$^2$. After the sandblasting treatment, the surface roughness of the Zr-based amorphous alloy component is increased from 0.015 μm to 1.565 μm, the fracture strain is increased from 2.20% to 2.92%, and the compressive strength is increased from 2000 MPa to 2392 MPa.

A third embodiment of the method for making the Zr-based amorphous alloy component is similar to the first embodiment, except that the grain size of the aluminium oxide sand is 150 μm. After the sandblasting treatment, the surface roughness of the amorphous alloy component is increased from 0.015 μm to 0.708 μm, the fracture strain is increased from 2.2% to 3.2%, and the compressive strength is increased from 2000 MPa to 2420 MPa.

A fourth embodiment of the method for making the Zr-based amorphous alloy component is similar to the second embodiment, except that the grain size of the aluminium oxide sand is 150 μm. After the sandblasting treatment, the surface roughness of the amorphous alloy component is increased from 0.015 μm to 1.115 μm, the fracture strain is increased from 2.20% to 3.10%, and the compressive strength is increased from 2000 MPa to 2423 MPa.

A fifth embodiment of the method for making the Zr-based amorphous alloy component is similar to the first embodiment, except that the surface of the Zr-based amorphous alloy component has been polished by chemical or mechanical polishing process before sandblasting. After the sandblasting treatment, the surface roughness of the amorphous alloy component is increased from 0.020 μm to 1.148 μm, the fracture strain is increased from 2.20% to 3.00%, and the compressive strength is increased from 2000 MPa to 2410 MPa.

A sixth embodiment of the method for making the Zr-based amorphous alloy component is similar to the fifth embodiment, except that the grain size of aluminium oxide sand is 150 μm. After the sandblasting treatment, the surface roughness of the amorphous alloy component is increased from 0.020 μm to 0.804 μm, the fracture strain is increased from 2.20% to 2.98%, and the compressive strength is increased from 2000 MPa to 2415 MPa.

A seventh embodiment of the method for making the Zr-based amorphous alloy component is similar to the fifth embodiment, except that the air pressure is 4.5 kgf/cm$^2$. After the sandblasting treatment, the surface roughness of the amorphous alloy component is increased from 0.015 μm to 1.726 μm, the fracture strain is increased from 2.20% to 2.95%, and the compressive strength is increased from 2000 MPa to 2380 MPa.

An eighth embodiment of the method for making the Zr-based amorphous alloy component is similar to the seventh embodiment, except that the grain size of the aluminium oxide sand is 150 μm. After the sandblasting treatment, the surface roughness of the amorphous alloy sheet is increased from 0.015 μm to 1.053 μm, the fracture strain is increased from 2.20% to 3.15%, and the compressive strength is increased from 2000 MPa to 2416 MPa.

Figure 3:
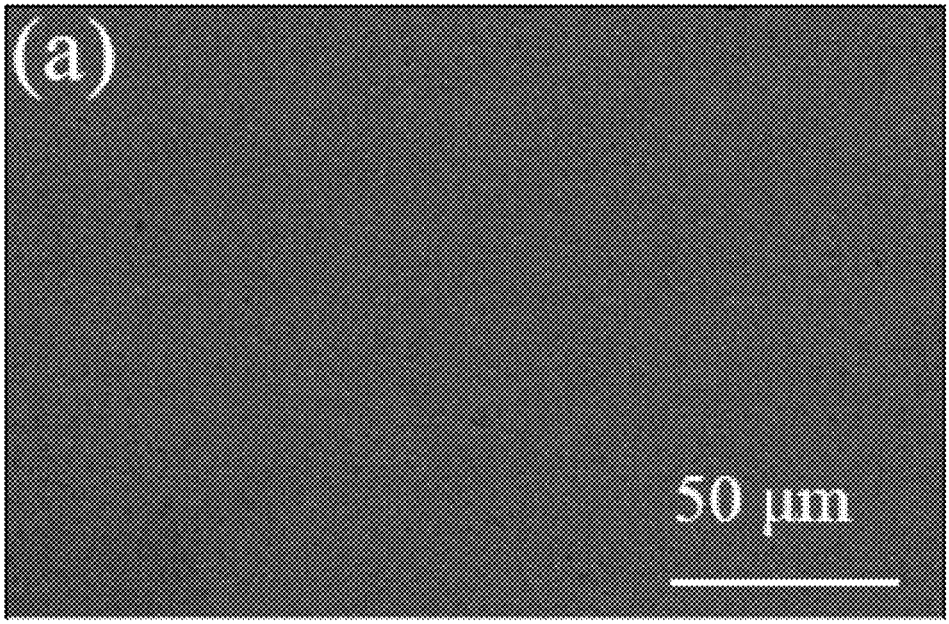
FIG. 3 shows a scanning electron microscope (SEM) photo of the Zr-based amorphous alloy component before it has been sandblasted.
Figure 4:
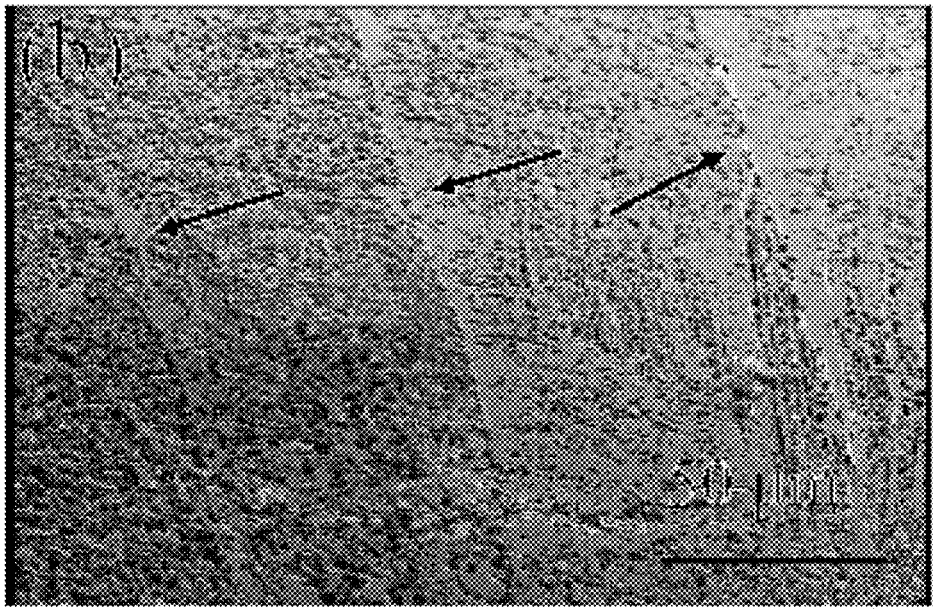
FIG. 4 shows a SEM photo of the Zr-based amorphous alloy component after it has been sandblasted.

As described above, with respect to the amorphous alloy component of the first embodiment to the eighth embodiment of instant disclosure, after the sandblasting treatment, both of the fracture strain and the compressive strength of the Zr-based amorphous alloy component have been enhanced. In comparison to the surface of the Zr-based amorphous alloy component of FIG. 3, FIG. 4 shows that multiple shear zones are formed on the surface of the Zr-based amorphous alloy component after the sandblasting treatment. The shear zones decrease stress concentration, consequently decrease fracture strain and increase the compressive strength of the Zr-based amorphous alloy component. Thus, the Zr-based amorphous alloy component becomes more ductile and more resilient to fractures.

It is to be understood, however, that even through numerous characteristics and advantages of the disclosure have been set forth in the foregoing description, together with details of the structure and function of the present disclosure, the disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A surface treating method, comprising:

providing an amorphous alloy sheet;

fixing the amorphous alloy sheet into a dry blast machine; and treating the surface of the amorphous alloy sheet by sandblasting, wherein in the sandblasting, air pressure is controlled to be in a range from about 1.5 kgf/cm$^2$ to 6.0 kgf/cm$^2$ and blasting time is controlled to be in a range from about 1 second to 60 seconds; a sand used in sandblasting is selected from a group consisting of aluminium oxide, zirconium dioxide and silicon dioxide, and a grain size of the sand is in a range from about 100 μm to 250 μm.

2. The surface treating method of claim 1, wherein the amorphous alloy sheet comprises 50 to 70 weight percent zirconium (Zr), 10 to 15 weight percent copper (Cu), 5 to 10 weight percent nickel (Ni), 5 to 20 weight percent niobium (Nb), and 5 to 10 weight percent aluminum (Al).

3. The surface treating method of claim 1, wherein the amorphous alloy sheet has been polished by chemical or mechanical polishing process before sandblasting.

4. The surface treating method of claim 1, wherein the amorphous alloy sheet is iron-based, cobalt-based or nickel-based amorphous alloy.

* * * * *